United States Patent [19]

Held et al.

[11] 4,112,844

[45] Sep. 12, 1978

[54] RELEASING DEVICE WITH PRESET RESPONSE SENSITIVITY FOR ELECTRICAL FUZES FOR USE WITH MINES

[75] Inventors: Manfred Held, Kuhbach; Hans Spies, Pfaffenhofen, both of Germany

[73] Assignee: Messerschmitt-Bolkow-Blohm Gesellschaft mit Beschrankter Haftung, Munich, Germany

[21] Appl. No.: 177,179

[22] Filed: Sep. 1, 1971

[30] Foreign Application Priority Data

Sep. 26, 1970 [DE] Fed. Rep. of Germany ..... 2047422

[51] Int. Cl.[2] ..... F42C 15/14

[52] U.S. Cl. ..... 102/19.2

[58] Field of Search ..... 102/8, 18, 19.2, 70.2 R, 102/70.2 GA

[56] References Cited

U.S. PATENT DOCUMENTS

| | | | |
|---|---|---|---|
| 2,411,787 | 11/1946 | Hammond | 102/19.2 |
| 2,569,808 | 10/1951 | Ensign | 102/8 |
| 2,702,003 | 2/1955 | Johnson | 102/18 |
| 2,802,420 | 8/1957 | MacDonald | 102/18 |
| 3,094,929 | 6/1963 | McGinley et al. | 102/18 |
| 3,397,329 | 8/1968 | Riedel | 102/70.2 X |
| 3,665,860 | 5/1972 | West | 102/19.2 |

*Primary Examiner*—Charles T. Jordan

*Attorney, Agent, or Firm*—Toren, McGeady and Stanger

[57] ABSTRACT

The releasing device comprises a piezoelectrical acceleration pick-up connected electrically with a parallel connection comprising a first instantaneous-response and a second delayed-response threshold switch, the switches having different respective threshold values. A switch actuated by the threshold switches is also incorporated which, in the presence of a signal from the first threshold switch, blocks ignition initiation. When the second threshold switch has a considerably lower threshold value than the first, ignition is initiated only in the event of slight accelerations of the piezoelectrical acceleration pick-up, for instance on manual mine clearance. In the event of strong, short-term shock pressures, for example due to a shell detonating in the vicinity of the releasing device, ignition is hindered.

1 Claim, 2 Drawing Figures

Fig. 1
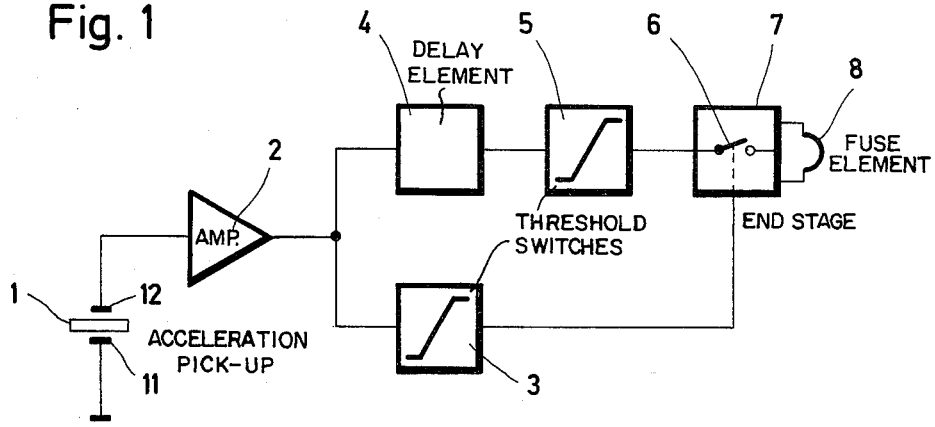
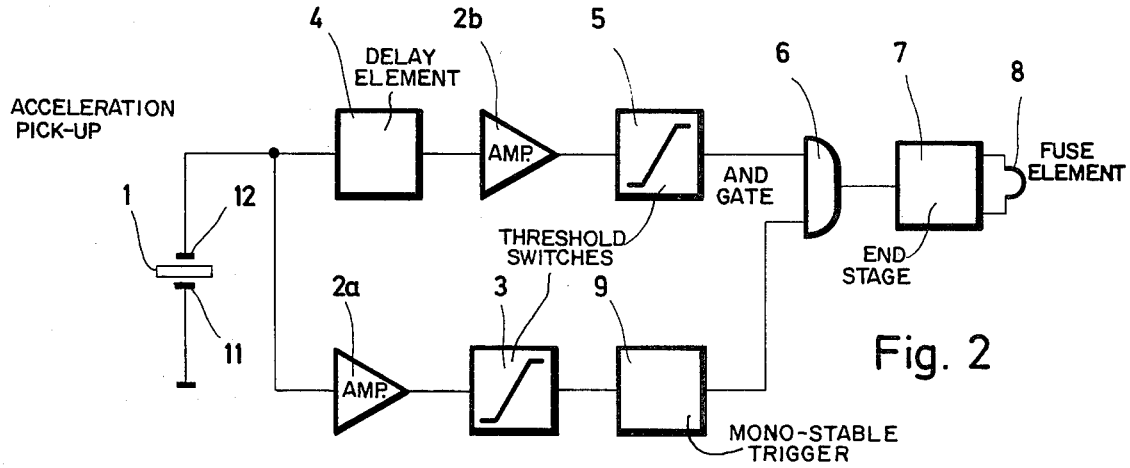
Fig. 2
INVENTORS
Manfred Held
Hans Spies
By
ATTORNEYS

RELEASING DEVICE WITH PRESET RESPONSE SENSITIVITY FOR ELECTRICAL FUZES FOR USE WITH MINES

FIELD OF THE INVENTION

This invention relates to releasing devices for electrical fuzes for use with mines and, more particularly, to a simplified releasing device of this type using electronic components whose response sensitivity can be set in action most precisely.

BACKGROUND OF THE INVENTION

Known releasing devices for this type of fuze generally comprise mechanical and/or pneumatic delay elements which effect ignition of the explosive charge of the mine only when the pressure applied to an ignition mechanism exceeds a certain magnitude and duration. This has the aim of preventing ignition of the explosive charge of the mine due to short-term, high pressure applied to the fuze mechanism, for instance due to shock waves resulting from shell detonating in the vicinity or from a roll-over device for mine clearance. Known releasing devices likewise do not respond to slight, long-lasting loads occurring, for example, on manual mine clearance.

In order to achieve a defined response sensitivity with known releasing devices, sophisticated precision designs are generally required which, furthermore, permit, only at additional expense of adjustable response sensitivity, to satisfy combat field conditions. Bearings for moving parts cannot be greased, for instance, since lubricants oxidize when mines are stored for a longer period of time, hence impairing the functioning of the releasing device. For this reason, all moving parts must be pivoted dry. This implies, however, precision manufacture and a considerable loss of accuracy.

On account of the sophisticated and, in addition, expensive precision design of the releasing device, the device is extremely sensitive to shocks occurring on a field of combat and hence no longer guarantees reliable application.

SUMMARY OF THE INVENTION

This invention relates to a releasing device, having preset response sensitivity, for electrical fuzes for use with mines. It is an object of the invention to simplify the above releasing devices by eliminating the mentioned disadvantages through the use of electronic parts whose response sensitivity can be set most exactly. The explosive charge of the mine shall be ignited preferably only in the event of slight, long-lasting accelerations occurring, for instance, on manual mine clearance and on treading on the mine, and not in the event of strong vibration and shock pressure.

The invention solves this problem by means of a piezoelectrical acceleration pick-up connected electrically to a parallel connection comprising a first instantaneous-response and a second delayed-response threshold switch. The second threshold switch exhibits a different threshold value from that of the first. A switch actuated by the threshold switches is also incorporated which, in the presence of a signal from the instantaneous-response threshold switch, blocks ignition initiation.

According to the invention, the response sensitivity of the releasing device can be adjusted at any time to conform to combat field requirements by modifying the threshold values and time delay of both threshold switches. Furthermore, thanks to current developments in semiconductor technology, the releasing device is small, cheap, simple to manufacture and has low power consumption.

According to a preferred embodiment of the invention, the second threshold switch exhibits a considerably lower threshold value than that of the first. Hence ignition of the explosive charge of the mine can be effected only by slight, long-term accelerations, as for instance on manual mine clearance or on treading on the mine, and hindered in the event of strong, short-term shock pressure.

For an understanding of the principles of the invention, reference is made to the following description of typical embodiments thereof as illustrated in the accompanying drawing.

BRIEF DESCRIPTION OF THE DRAWING

In the drawing:

FIG. 1 is a block circuit diagram of a releasing device for electrical mine fuzes as a first embodiment of the invention; and FIG. 2 illustrates a further embodiment of a releasing device in accordance with the invention.

DESCRIPTION OF THE PREFERRED EMBODIMENTS

Piezoelectrical acceleration pick-up 1, which is connected by means of its one electrode 11 to ground, supplies a voltage, on the occurrence of acceleration, to amplifier 2 (FIG. 1) via its second electrode 12. The output voltage of amplifier 2 serves as an input signal for threshold switch 3, whose threshold value is such that an output signal is given only in the event of extremely high accelerations or shock pressure acting on acceleration pick-up 1.

Delay element 4 and a second threshold switch 5 are connected in series parallel to the first threshold switch 3. Switch 5 has a threshold value responding to slight accelerations or pressure shocks. The outputs of both threshold switches 3 and 5 are connected to the inputs of an end stage 7 provided with switch 6, which for its part actuates an electrically triggered fuze element 8. The electronic system is fed by a power supply not shown, for instance by solid electrolyte batteries or batteries which can be activated or recharged.

In the event that a voltage is generated at electrodes 11 and 12 of piezoelectrical acceleration pick-up 1, and which results from a slight acceleration, and which voltage, subsequent to amplification by amplifier 2, does not excite threshold switch 3, threshold switch 5 actuates end stage 7 after delay in delay element 4, thus actuating fuze element 8.

In the event that the voltage generated by piezoelectrical acceleration pick-up 1, subsequent to amplification by amplifier 3, is so high, however, that threshold switch 3 is exicted, the end stage is blocked via threshold switch 3 before end stage 7 can be actuated via delay element 4 and the second threshold switch 5, so that the subsequently occurring pulse via threshold switch 5 does not actuate fuze element 8. Blocking of end stage 7 is effected by means of known electronic configurations which have not been shown, for example by discharging the fuze capacitor via a thyristor stage over a certain period of time.

Should the releasing device be blocked merely in the event of extremely high peak loads on piezoelectrical acceleration pick-up 1, for instance on the occurrence of a shock wave due to a shell bursting in the immediate vicinity, it is expedient (FIG. 2) to employ respective amplifiers 2*a* and 2*b*, connected directly before threshold switches 3 and 5, the amplifiers being designed for different respective input voltages and exhibiting different respective gains. This offers the advantage that the response sensitivities can be set exactly and, at the same time, that threshold switches 3 and 5 can have the same electrical circuitry and dimensioning.

Particularly good discrimination of the response sensitivity is achieved when amplifier 2*a*, connected before the first threshold switch 3, exhibits a low gain and a large bandwidth for input voltages occurring at high accelerations in higher frequency ranges, and when amplifier 2*b*, connected before the second threshold switch 5, exhibits a high gain and a narrow bandwidth for input voltages occurring at slight accelerations in lower frequency ranges.

The mode of operation of this second embodiment of the invention is the same as described in FIG. 1 and, for the sake of clarity, like parts are identified with the same reference numbers in both figures.

A voltage signal from piezoelectrical acceleration pick-up 1, which does not reach the threshold value of threshold switch 3 subsequent to amplification by amplifier 2*a*, serves, after delay in delay element 4 and amplification in amplifier 2*b*, which can also be combined as one component, such as a filter, as an input signal for threshold switch 5, whose output is connected to the input of switch 6, switch 6 being designed as an AND-gate. The second input of AND-gate 6 is connected with threshold switch 3 via monostable trigger stage 9 supplying a signal voltage, when non-operative, to the AND-gate. Hence in the case described AND-gate 6 actuates end stage 7, with stage 7 exciting fuze element 8 electrically.

In the event that the output voltage of the piezoelectrical acceleration pick-up is so high that threshold switch 3 responds via amplifier 2*a*, switch 3 actuates monostable trigger stage 9 which eliminates the signal voltage to AND-gage 6 for a preset time, thus hindering actuation of final stage 7 and hence ignition of fuze element 8 during this time.

Naturally, setting the threshold values is described merely by means of examples, which means that it is clearly possible to set the threshold values of the first threshold switch 3 considerably lower than that of the second threshold switch 5, whereby ignition of fuze element 8 occurs only when the acceleration acting on piezoelectrical acceleration pick-up 1 is extremely large. In this way, for instance, transport safety is ensured.

What is claimed is:

1. Releasing device, having a preset sensitivity, for electrical fuzes for use with mines, comprising, in combination, a piezoelectrical acceleration pick-up; first and second circuits electrically connected, in parallel with each other, to said pick-up; said first circuit including a first threshold switch, and said second circuit including a delayed-response second threshold switch having a threshold value different from that of said first threshold switch; a fuze element operatively associated with both said circuits; switch means actuable by said threshold switches and controlling energization of said fuze element; said switch means blocking energization of said fuze element in the presence of a signal from said first threshold switch; respective amplifiers connecting said threshold switches to said pick-up; said amplifiers having respective different gains for respective different input voltage and respective frequency ranges; the amplifier connecting said first threshold switch to said pick-up having a low gain and a wide band width for input voltages resulting from high acceleration of said acceleration pick-up in higher frequency ranges; said amplifier connecting said second threshold switch to said pick-up having a high gain and narrow band width for input voltages resulting from low acceleration of said acceleration pick-up in low frequency ranges; said switch means including an AND-gate having an output controlling energization of said fuze element and respective inputs electrically connected to said first and second threshold switches; and a monostable trigger stage connecting said first threshold switch to the associated input of said AND-gate and, when non-operative, supplying a signal voltage to said AND-gate.

* * * * *